US011725673B2

(12) United States Patent
Ueda

(10) Patent No.: US 11,725,673 B2
(45) Date of Patent: Aug. 15, 2023

(54) DRIVE DEVICE FOR HYDRAULIC CYLINDER IN WORK MACHINE

(71) Applicant: KOBELCO CONSTRUCTION MACHINERY CO., LTD., Hiroshima (JP)

(72) Inventor: Koji Ueda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 97 days.

(21) Appl. No.: 17/423,746

(22) PCT Filed: Jan. 15, 2020

(86) PCT No.: PCT/JP2020/001063

§ 371 (c)(1),
(2) Date: Jul. 16, 2021

(87) PCT Pub. No.: WO2020/158390

PCT Pub. Date: Aug. 6, 2020

(65) Prior Publication Data

US 2022/0120295 A1 Apr. 21, 2022

(30) Foreign Application Priority Data

Jan. 28, 2019 (JP) ..... 2019-011950

(51) Int. Cl.
*F15B 11/048* (2006.01)
*E02F 9/22* (2006.01)
*F15B 13/043* (2006.01)

(52) U.S. Cl.
CPC ..... *F15B 11/048* (2013.01); *E02F 9/22* (2013.01); *F15B 13/0433* (2013.01);
(Continued)

(58) Field of Classification Search
CPC ..... F15B 11/046; F15B 11/048; F15B 11/126; F15B 15/24
See application file for complete search history.

(56) References Cited

U.S. PATENT DOCUMENTS 4,896,582 A 1/1990 Tordenmalm et al.
7,318,292 B2 * 1/2008 Helbling ..... E02F 9/2214 91/393

(Continued)

FOREIGN PATENT DOCUMENTS

CN 102575690 A 7/2012
JP 5-195552 A 8/1993

(Continued)

OTHER PUBLICATIONS

International Search Report dated Mar. 10, 2020 in PCT/JP2020/001063 filed Jan. 15, 2020, 3 pages.

(Continued)

*Primary Examiner* — Michael Leslie
(74) *Attorney, Agent, or Firm* — Oblon, McClelland, Maier & Neustadt, L.L.P.

(57) ABSTRACT

Provided is a driving apparatus capable of effectively preventing impact at the stroke end in the hydraulic cylinder. The driving apparatus includes a hydraulic pump, a cylinder control valve, an operation member, a drive command input unit inputting a cylinder drive command corresponding to a cylinder operation applied to the operation member to the cylinder control valve, a cylinder stroke detection unit, a cylinder drive command restriction unit restricting the cylinder drive command in response to the cylinder stroke to stop a piston of a hydraulic cylinder before the stroke end.

7 Claims, 9 Drawing Sheets

(52) U.S. Cl.
CPC ..... *F15B 2211/20523* (2013.01); *F15B 2211/20546* (2013.01); *F15B 2211/20576* (2013.01); *F15B 2211/30565* (2013.01); *F15B 2211/327* (2013.01); *F15B 2211/329* (2013.01); *F15B 2211/355* (2013.01); *F15B 2211/36* (2013.01); *F15B 2211/633* (2013.01); *F15B 2211/6309* (2013.01); *F15B 2211/6316* (2013.01); *F15B 2211/6336* (2013.01); *F15B 2211/6346* (2013.01); *F15B 2211/6355* (2013.01); *F15B 2211/6652* (2013.01); *F15B 2211/67* (2013.01); *F15B 2211/755* (2013.01); *F15B 2211/853* (2013.01); *F15B 2211/8606* (2013.01)

(56) References Cited

U.S. PATENT DOCUMENTS

| | | | | |
|---|---|---|---|---|
| 7,387,061 | B2 * | 6/2008 | Kobata | F15B 11/048 91/405 |
| 7,849,685 | B2 * | 12/2010 | Yamazaki | E02F 9/2214 60/403 |
| 10,344,783 | B2 * | 7/2019 | Wang | F15B 11/0445 |
| 2006/0263189 | A1 | 11/2006 | Vigholm | |
| 2007/0033934 | A1 | 2/2007 | Yamazaki et al. | |

FOREIGN PATENT DOCUMENTS

| | | | |
|---|---|---|---|
| JP | 8-200304 | A | 8/1996 |
| JP | 10-88623 | A | 4/1998 |
| JP | 11-81391 | A | 3/1999 |
| JP | 11-270514 | A | 10/1999 |
| JP | 2000-145717 | A | 5/2000 |
| JP | 2007-46732 | A | 2/2007 |
| JP | 2010-261521 | A | 11/2010 |
| JP | 2015-163754 | A | 9/2015 |
| JP | 2016-169796 | A | 9/2016 |
| JP | 2017-53413 | A | 3/2017 |
| JP | 2017-96215 | A | 6/2017 |
| WO | WO 2005/019656 | A1 | 3/2005 |
| WO | WO 2017/061220 | A1 | 4/2017 |

OTHER PUBLICATIONS

Extended European Search Report dated Dec. 17, 2021 in European Patent Application No. 20748351.2, 8 pages.
Combined Chinese Office Action and Search report dated Feb. 18, 2023, in corresponding Chinese Patent Application No. 202080007383.9 (with Partial English Translation and English Translation of Category of Cited Documents), 8 pages.
Office Action dated Mar. 7, 2023, in corresponding Japanese Patent Application No. 2019-011950 (with English Translation), 11 pages.

* cited by examiner

DRIVE DEVICE FOR HYDRAULIC CYLINDER IN WORK MACHINE

TECHNICAL FIELD

The present invention relates to an apparatus for driving a hydraulic cylinder installed in a working machine such as a hydraulic excavator.

BACKGROUND ART

Conventionally, often used are hydraulic cylinders as actuators provided in hydraulic working machines. For example, a work device constituting a hydraulic excavator includes a boom cylinder for raising and lowering a boom, an arm cylinder for rotationally moving an arm relatively to the boom, and a bucket cylinder for rotationally moving a bucket relatively to the arm.

The hydraulic cylinder includes a cylinder body forming a cylinder chamber, and a piston loaded in the cylinder chamber. The piston is able to be reciprocated in the cylinder chamber between opposite stroke ends, which are respective ends of the strokes in expansion and retracting directions. However, the dash of the piston onto the stroke end at a high speed involves a great impact.

Patent Document 1 discloses a control apparatus for reducing such an impact. The controller includes a deceleration means that decelerates the piston of the hydraulic cylinder to reduce the impact at the stroke end, and a deceleration setting means that sets a deceleration start position at which the deceleration means starts the deceleration of the piston to a position farther from the stroke end upstream as the movement speed of the piston increases.

This control apparatus, though being capable of decelerating the piston, is unable to completely prevent impact due to energy of the dash of the piston to the stroke end. Furthermore, large energy loss is likely to occur in the vicinity of the stroke end regardless of the deceleration, causing a decrease in the work efficiency. For example, in a hydraulic cylinder provided with a cushion projection formed in the distal end of the piston rod, a cushion chamber formed in the cylinder body to receive the cushion projection at the stroke end, and a throttle flow-path for letting the hydraulic fluid in the cushion chamber to the outside at a limited flow rate, in order to restrain the piston from impact contact with the cylinder body, a large fluid resistance is applied to the piston when the cushion projection runs into the cushion chamber and when the cushion projection leaves the cushion chamber, the fluid resistance involving a considerable energy loss.

CITATION LIST

Patent Literature

Patent Literature 1: Japanese Unexamined Patent Publication No. 2007-46732

SUMMARY OF INVENTION

An object of the present invention is to provide an apparatus for driving a hydraulic cylinder installed in a working machine, the apparatus being capable of effectively preventing an impact at a stroke end of the hydraulic cylinder and reducing energy loss.

Provided is an apparatus installed in a work machine to drive a hydraulic cylinder including a piston and a cylinder body forming a cylinder chamber that accommodates the piston so as to allow the piston to be reciprocated, the apparatus including: a hydraulic pump that discharges hydraulic fluid to be supplied to the cylinder chamber of the hydraulic cylinder; a cylinder control valve interposed between the hydraulic pump and the hydraulic cylinder and configured to be opened by input of a cylinder drive command to the cylinder control valve to change a direction and a flow rate of the hydraulic fluid supplied from the hydraulic pump to the hydraulic cylinder in response to the cylinder drive command; an operation member allowing a cylinder operation for moving the hydraulic cylinder to be applied to the operation member by an operator; a drive command input unit that generates the cylinder drive command corresponding to the cylinder operation applied to the operation member and inputs the cylinder drive command to the cylinder control valve; a cylinder stroke detection unit that detects a cylinder stroke that is a stroke of the hydraulic cylinder; and a drive command restriction unit that restricts the cylinder drive command to be input from the drive command input unit to the cylinder control valve in response to the cylinder stroke so as to stop the piston before a stroke end of the hydraulic cylinder regardless of the cylinder operation.

DESCRIPTION OF EMBODIMENTS

There will be described preferred embodiments of the invention with reference to the drawings.

Figure 1:
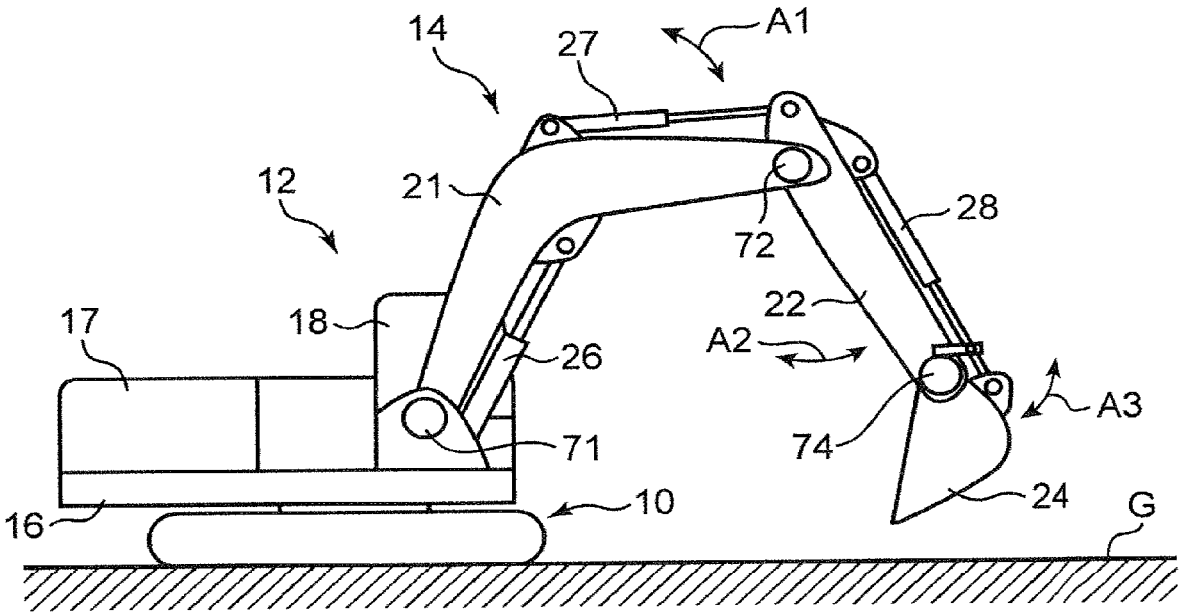
FIG. 1 is a side view of a hydraulic excavator which is a work machine according to an embodiment of the present invention.

FIG. 1 shows a hydraulic excavator that is an example of a working machine in which a hydraulic cylinder according to the embodiment of the present invention and a driving apparatus for driving the hydraulic cylinder are installed. The hydraulic excavator includes a lower traveling body 10 capable of traveling on the ground G, an upper turning body 12 mounted on the lower traveling body 10, and a work device 14 mounted on the upper turning body 12.

The lower traveling body 10 and the upper turning body 12 constitute a machine body that supports the work device 14. The upper turning body 12 includes a turning frame 16 and a plurality of elements mounted thereon. The plurality of elements include an engine room 17 for accommodating an engine and a cab 18 which is an operation room.

The work device 14 is capable of making motions for excavation work and other necessary work, including a boom 21, an arm 22, and a bucket 24. The boom 21 has a proximal end and a distal end opposite thereto, the proximal end being supported on a front end of the turning frame 16 so as to be raisable and lowerable, that is, movable rotationally about a horizontal axis, as indicated by arrow A1 in FIG. 1. The arm 22 has a proximal end, which is attached to the distal end of the boom 21 so as to be movable rotationally about a horizontal axis as indicated by arrow A2 in FIG. 1, and a distal end opposite to the proximal end. The bucket 24 is attached to the distal end of the arm 22 so as to be movable rotationally as indicated by arrow A3 in FIG. 1.

The work device 14 is provided with a plurality of expandable hydraulic cylinders which are actuators for actuating the boom 21, the arm 22 and the bucket 24, respectively. The plurality of hydraulic cylinders include at least one boom cylinder 26, an arm cylinder 27, and a bucket cylinder 28. The at least one boom cylinder 26 is expanded or contracted by supply of hydraulic fluid thereto, thereby rotationally moving the boom 21 in a rising direction or a falling direction. The arm cylinder 27 is interposed between the boom 21 and the arm 22, and expanded and contracted so as to rotationally move the arm 22 in an arm crowding direction (a direction in which the distal end of the arm 22 approaches the boom 21) and an arm dumping direction (a direction in which the distal end of the arm 22 moves away from the boom 21) by supply of hydraulic fluid thereto. The bucket cylinder 28 is expanded and contracted to move the bucket 24 rotationally by supply of hydraulic fluid thereto.

The boom cylinder 26, the arm cylinder 27 and the bucket cylinder 28 have mutually resembling structure. Accordingly, next will be described the structure of the arm cylinder 27 which is a hydraulic cylinder to be driven by a below-described driving apparatus and to be controlled in this embodiment, out of the cylinders 26 to 28, with reference to FIGS. 2 and 3.

The arm cylinder 27 includes a cylinder body 27*c* forming a cylinder chamber, a piston 27*p* loaded in the cylinder chamber, and a piston rod 27*r* extending from the piston 27*p* in one of the axial directions. The piston 27*p* is loaded into the cylinder chamber so as to be slidable in the axial direction with close contact with the inner peripheral surface of the cylinder body 27*c*, thereby partitioning the cylinder chamber into a rod-side chamber 27*b* in which the piston rod 27*r* is located and a head-side chamber 27*a* opposite to the rod-side chamber 27*b*.

The piston 27*p* is moved integrally with the piston rod 27*r* axially thereof in response to the supply of hydraulic fluid to the cylinder chamber, thereby expanding the entire arm cylinder 27. Specifically, by supply of hydraulic fluid to the head-side chamber 27*a*, the piston 27*p* is moved in a direction to expand the head-side chamber 27*a* and extrude the hydraulic fluid in the rod-side chamber 27*b*. The entire arm cylinder 27 is thereby expanded to move the arm 22 in the arm crowding direction. By supply of hydraulic fluid to the rod-side chamber 27*b*, conversely, the piston 27*p* is moved in a direction to expand the rod-side chamber 27*b* and extrude the hydraulic fluid in the head-side chamber 27*a*. The entire arm cylinder 27 is thereby contracted to move the arm 22 in the arm dumping direction.

The arm cylinder 27 have stroke ends which are the opposite ends of the cylinder stroke corresponding to the movement of the piston 27*p* with respect to the expansion direction and the contracting direction, respectively, between which stroke ends the piston 27*p* is able to be reciprocated. Each of the stroke ends is provided with a cushion structure for mitigating collision of the piston 27*p* with the cylinder body 27*c*.

Figure 3:
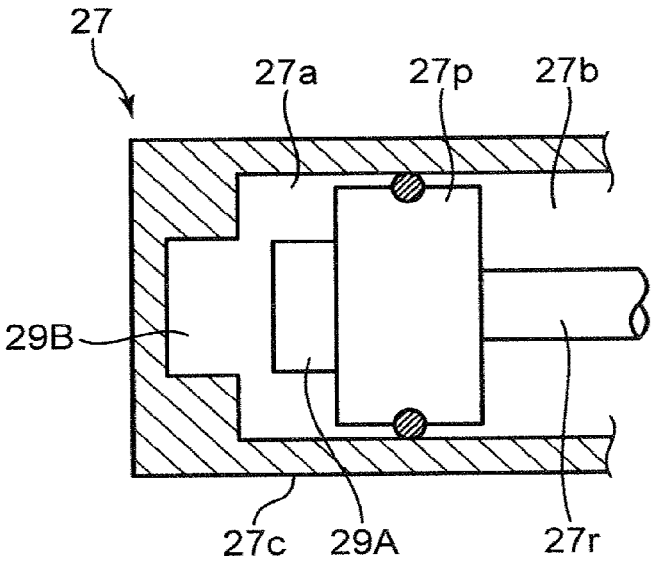
FIG. 3 is a cross-sectional view showing a cushion structure provided in the rod-side end of the arm cylinder included in the hydraulic circuit.

FIG. 3 shows the cushion structure that is provided to the head-side end, i.e. the stroke end with respect to the contraction direction, out of the cushion structures. The cushioning structure includes a cushion projection 29A, a cushion chamber 29B, and a not-graphically-shown relief flow-path. The cushion projection 29A projects from the piston 27*p* to the side opposite to the piston rod 27*r* (i.e., into the rod-side chamber 27*a*). The cushion chamber 29B is a recess formed in the cylinder body 27*c*, having a shape for receiving the cushion projection 29A when the piston 27*p* reaches the contraction-side stroke end. The relief flow-path is a flow-path that allows the hydraulic fluid in the cushion chamber 29B to flow out of the cushion chamber 29B at a restricted flow rate when the cushion projection 29A runs into the cushion chamber 29B, having a flow-path resistance that reduces the impact due to the abutment between the cylinder body 27*c* and the piston 27*p*.

Figure 2:
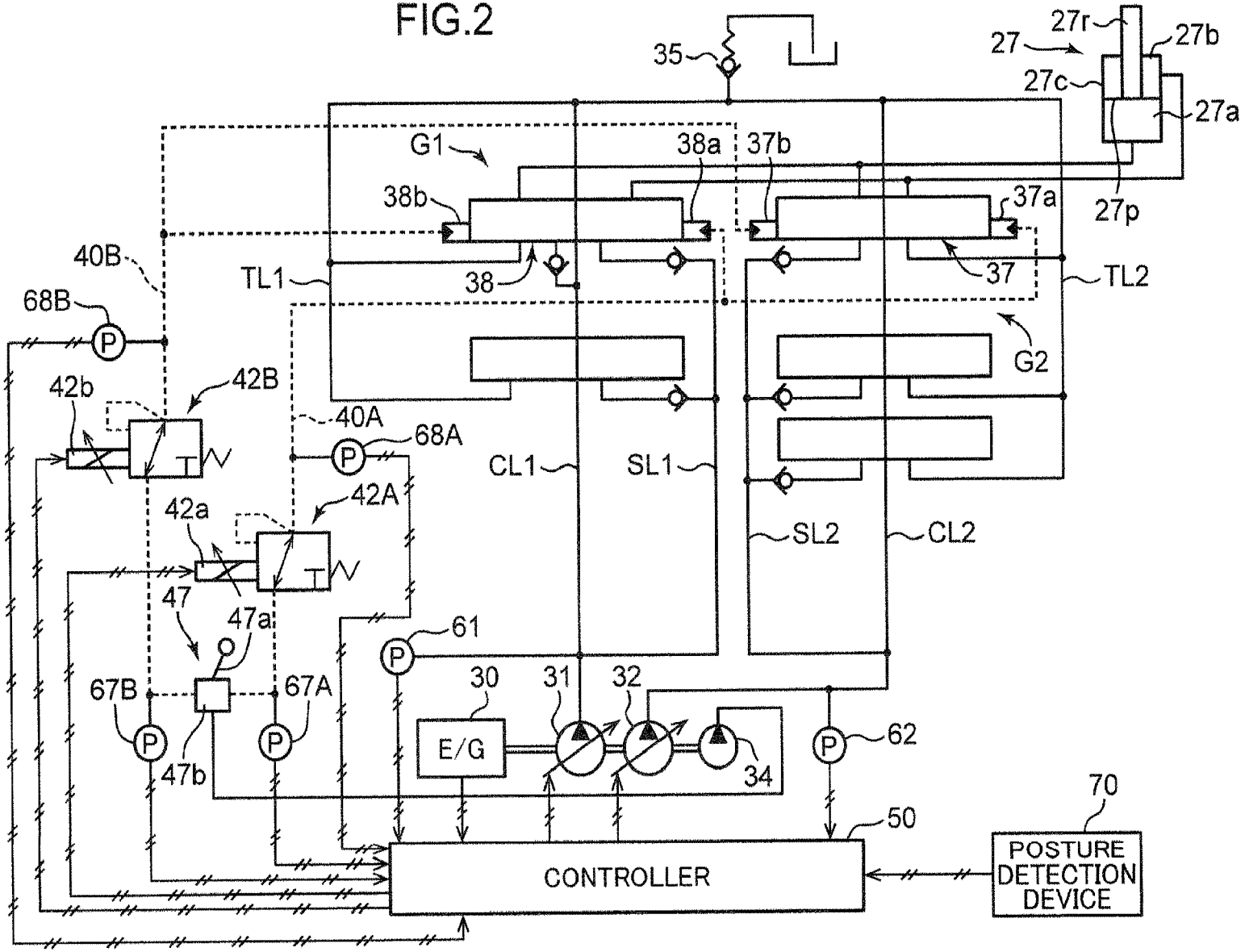
FIG. 2 is a hydraulic circuit diagram showing a hydraulic circuit installed in the hydraulic excavator and a controller connected thereto.

FIG. 2 shows a hydraulic circuit installed in the hydraulic excavator. The hydraulic circuit has a function of supplying hydraulic fluid to the plurality of hydraulic actuators including the arm cylinder 27 and controlling the direction and the flow rate of the supply. Specifically, the hydraulic circuit includes: a plurality of hydraulic pumps connected to an output shaft of an engine 30 mounted on the hydraulic excavator, namely, a first main pump 31, a second main pump 32 and a pilot pump 34; a plurality of actuator control valves; and a plurality of actuator operation devices, being electrically connected to a controller 50 for controlling the operation of the hydraulic circuit.

Each of the plurality of hydraulic pumps is driven by the engine 30, thereby discharging fluid in the tank. The first and second main pumps 31 and 32 are configured to discharge fluid in the tank as hydraulic fluid to directly move the plurality of hydraulic actuators, corresponding to the hydraulic pump according to the present invention, that is, a hydraulic pump for driving the hydraulic cylinder. The pilot pump 34 is a pilot hydraulic source that discharges pilot fluid for supplying pilot pressure to the plurality of actuator control valves. Each of the first and second main pumps 31 and 32 according to this embodiment is a variable displacement hydraulic pump, having a capacity, namely, a pump capacity, operable by a pump capacity command that is input from the controller 50 to each of the first and second main pumps 31 and 32.

The plurality of actuator control valves are interposed between the first main pump 31 or the second main pump 32 and a plurality of hydraulic actuators corresponding to the plurality of actuator control valves, respectively, and operated to control the direction and the flow rate of hydraulic fluid supplied from the first main pump 31 or the second main pump 32 to the hydraulic actuators. Each of the plurality of actuator control valves is a pilot-operated hydraulic selector valve, which is opened by supply of the pilot pressure by a stroke corresponding to the magnitude of the pilot pressure to thereby allow hydraulic fluid to be supplied to the hydraulic actuator at a flow rate corresponding to the stroke. The flow rate, therefore, can be controlled through changing the pilot pressure.

In this embodiment, the plurality of actuator control valves are distributed to a first group G1 and a second group G2. The actuator control valve belonging to the first group G1 is connected to the first main pump 31 so as to be supplied with the hydraulic fluid discharged from the first main pump 31, and the actuator control valve belonging to the second group G2 is connected to the second main pump 32 so as to be supplied with the hydraulic fluid discharged from the second main pump 32. Specifically, the discharge port of the first main pump 31 can be connected with a first center bypass line CL1 connected to the tank via the back pressure valve 35, and the actuator control valves belonging to the first group G1 are arranged in tandem along the first center bypass line CL1. Similarly, the discharge port of the second main pump 32 can be connected with a second center bypass line CL2 connected to the tank via the back pressure valve 35, and the actuator control valves belonging to the second group G2 are arranged in tandem along the second center bypass line CL2.

To the discharge port of the first main pump 31, a first supply line SL1 is connected in parallel with the first center bypass line CL1. The first supply line SL1 is further branched correspondingly to the plurality of actuator control valves belonging to the first group G1, being connected to the actuator control valves so as to distribute the hydraulic fluid discharged from the first main pump 31 to the actuator control valves belonging to the first group G1. Besides, the plurality of actuator control valves belonging to the first group G1 is connected to the back pressure valve 35 via a first tank line TL1.

Similarly, to the discharge port of the second main pump 32, a second supply line SL2 is connected in parallel with the second center bypass line CL2. The second supply line SL2 is further branched correspondingly to the plurality of actuator control valves belonging to the second group G2, and the second supply line SL2 is connected to the actuator control valves belonging to the second group G2 to distribute the hydraulic fluid discharged from the second main pump 32 to the actuator control valves belonging to the second group G2. Besides, the plurality of actuator control valves belonging to the second group G2 is connected to the back pressure valve 35 via a second tank line TL2.

The plurality of actuator control valves include an arm first-speed control valve 37 and an arm second-speed control valve 38 as shown in FIG. 2 to serve as control valves for controlling the motion of the arm cylinder 27.

The arm first-speed control valve 37 belongs to the second group G2, being opened so as to control the supply of hydraulic fluid from the second main pump 32 to the arm cylinder 27. Specifically, the arm first-speed control valve 37 is opened so as to form fluid paths which allow the hydraulic fluid discharged from the second main pump 32 to be supplied to the head-side chamber 27*a* or the rod-side chamber 27*b* of the arm cylinder 27 and allows the hydraulic fluid discharged from the rod-side chamber 27*b* or the head-side chamber 27*a* to return to the tank through the second tank line TL2.

The arm second-speed control valve 38 belongs to the first group G1, being opened so as to allow the hydraulic fluid discharged from the first main pump 31 to be merged with the hydraulic fluid discharged from the second main pump 32, to serve as speed-increasing hydraulic fluid. Specifically, the arm second-speed control valve 38 is opened so as to form fluid paths that allow the hydraulic fluid discharged from the first main pump 31 to be merged with the hydraulic fluid supplied from the arm first-speed control valve 37 to the head-side chamber 27*a* or the rod-side chamber 27*b* of the arm cylinder 27 and allow the hydraulic fluid discharged from the rod-side chamber 27*b* or the head-side chamber 27*a* to return to the tank through the first tank line TL1.

Each of the actuator control valves including the arm first-speed control valve 37 and the arm second-speed control valve 38 is a pilot-operated selector valve with three positions, having a pair of pilot ports. Specifically, the arm first-speed control valve 37 has an arm-crowding pilot port 37*a* and an arm-dumping pilot port 37*b* opposite thereto. Similarly, the arm second-speed control valve 38 has an arm-crowding pilot port 38*a* and an arm-dumping pilot port 38*b* opposite thereto.

The arm first-speed control valve 37 is kept at a neutral position with no or minute pilot pressure supplied to the arm-crowding and arm-dumping pilot ports 37*a* and 37*b*, blocking the arm cylinder 27 from the second main pump 32 while opening the second center bypass line CL2. The arm first-speed control valve 37 is shifted from the neutral position, by supply of a pilot pressure equal to or higher than a predetermined value is supplied to the arm-crowding pilot port 37*a* or the arm-dumping pilot port 37*b*, by a valve stroke corresponding to the magnitude of the pilot pressure in the direction corresponding to the pilot port, to provide communication between the second supply line SL2 and the head-side chamber 27*a* or the rod-side chamber 27*b* of the arm cylinder 27 with an opening area corresponding to the valve stroke, thereby expanding and contracting the arm cylinder 27 in a direction corresponding to the valve stroke (for example, in an arm crowding direction when a pilot pressure is inputted to the arm-crowding pilot port 37*a*) at a speed corresponding to the valve stroke.

The arm second-speed control valve 38 is kept at a neutral position with no or minute pilot pressure supplied to the arm-crowding pilot port 38*a* and the arm-dumping pilot port 38*b*, blocking the arm cylinder 27 from the first main pump 31 and opening the first center bypass line CL1. The arm second-speed control valve 38 is shifted from the neutral position, by supply of pilot pressure equal to or higher than a predetermined value to the arm-crowding pilot port 38*a* or the arm-dumping pilot port 38*b*, by a valve stroke corresponding to the magnitude of the pilot pressure in the direction corresponding to the pilot port, to provide communication between the first supply line SL1 and the head-side chamber 27*a* or the rod-side chamber 27*b* of the arm cylinder 27 with an opening area corresponding to the valve stroke, thereby expanding and contracting the arm cylinder 27 in the direction corresponding to the valve stroke (for example, in the arm crowding direction when a pilot pressure is inputted to the arm-crowding pilot port 38*a*) at a speed corresponding to the valve stroke.

The plurality of actuator operation devices are connected to the plurality of actuator control valves, respectively, and allows an operation for moving the hydraulic actuator connected to the actuator control valve to be applied to the actuator operation device to input a pilot pressure corresponding to the operation to the pilot port of the actuator control valve. Specifically, the plurality of actuator operation devices are provided between the pilot pump 34 and the plurality of actuator control valves, respectively, being configured to regulate the pilot primary pressure output from the pilot pump 34 to a degree corresponding to the operation to generate a pilot secondary pressure, and configured to input the pilot secondary pressure to the pilot port of the actuator control valve as the pilot pressure of the actuator control valve.

The plurality of actuator operation devices include an arm operation device 47 shown in FIG. 2 serving as an operation device for moving the arm cylinder 27. The arm operation device 47 allows an arm crowding operation and an arm dumping operation to be applied to the arm operation device 47 as a cylinder operation for expanding and contracting the arm cylinder 27 (for moving in the arm crowding direction and the arm dumping direction), and inputs a pilot pressure corresponding thereto as a cylinder drive command to the arm first-speed and the second-speed control valves 37 and 38, respectively.

Specifically, the arm operation device 47 includes an arm operation lever 47*a*, and an arm pilot valve 47*b* connected thereto. The arm operation lever 47*a* is an operation member to which the arm crowding operation and the arm dumping operation is applied by the operator. The arm pilot valve 47*b* is a pressure reducing valve that generates a pilot pressure corresponding to the arm crowding operation or the arm dumping operation applied to the arm operation lever 47*a*, that is, the cylinder drive command, on the secondary side of the arm pilot valve 47*b* and inputs the pilot pressure to the arm first-speed control valve 37, thus constituting a drive command input unit according to the present invention in cooperation with the pilot pump 34. In response to the application of the arm crowding operation to the arm operation lever 47*a*, the arm pilot valve 47*b* generates an arm-crowding operation pilot pressure Pa1 to expand the arm cylinder 27 at a speed corresponding to the magnitude of the arm crowding operation, the arm-crowding pilot pressure Pa1 being able to be input to the arm-crowding pilot port 37*a* of the arm first-speed control valve 37 and the arm-crowding pilot port 38*a* of the arm second-speed control valve 38 through the arm-crowding pilot line 40A. In response to the application of the arm dumping operation to the arm operation lever 47*a*, conversely, the arm pilot valve 47*b* generates an arm-dumping operation pilot pressure Pb1 to contract the arm cylinder 27 at a speed corresponding to the magnitude of the arm dumping operation, the arm-dumping operation pilot pressure Pb1 being able to be input to the arm-dumping pilot port 37*b* of the arm first-speed control valve 37 and the arm-dumping pilot port 38*b* of the arm second-speed control valve 38 through the arm-dumping pilot line 40B.

The hydraulic circuitry shown in FIG. 2 further includes an arm-crowding pilot pressure restriction valve 42A and an arm-dumping pilot pressure restriction valve 42B. The arm-crowding pilot pressure restriction valve 42A and the arm-dumping pilot pressure restriction valve 42B are provided in the middle of the arm-crowding pilot line 40A and the arm-dumping pilot line 40B, respectively, functioning as means for restricting the pilot pressure to be supplied from the arm pilot valve 47*b* to the arm first-speed and the second-speed control valves 37 and 38.

The arm-crowding pilot pressure restriction valve 42A and the arm-dumping pilot pressure restriction valve 42B according to this embodiment are solenoid inverse proportional valves having respective solenoids 42*a* and 42*b*, being configured to perform restriction on the pilot pressure in response to a pilot pressure restriction command that is an electric signal input to the solenoids 42*a* and 42*b*. Specifically, when the arm-crowding operation pilot pressure Pa1, which is the pilot pressure input from the arm pilot valve 47*b*, is smaller than a restriction pilot pressure Pir corresponding to the pilot pressure restriction command, the arm-crowding pilot pressure restriction valve 42A is opened to allow the arm-crowding operation pilot pressure Pa1 to be directly input to the arm-crowding pilot ports 37*a* and 38*a* of the arm first-speed and second-speed control valves 37 and 38 as the final arm-crowding pilot pressure Pa2; when the arm-crowding operation pilot pressure Pa1 is equal to or greater than the restriction pilot pressure Pir, the arm-crowding pilot pressure restriction valve 42A is opened to restrict the final arm-crowding pilot pressure Pa2 to be input to the arm first-speed and second-speed control valves 37 and 38 to the restriction pilot pressure Pir regardless of the magnitude of the arm-crowding operation pilot pressure Pa1. Similarly, when the arm-dumping operation pilot pressure Pb1, which is the pilot pressure input from the arm pilot valve 47*b*, is smaller than the restriction pilot pressure Pir, the arm-dumping pilot pressure restriction valve 42B is opened to allow the arm-dumping operation pilot pressure Pb1 to be directly input to the arm-dumping pilot ports 37*b* and 38*b* of the arm first-speed and second-speed control valves 37 and 38 as the final arm-dumping pilot pressure Pb2; when the arm-dumping operation pilot pressure Pb1 is equal to or greater than the restriction pilot pressure Pir, the arm-dumping pilot pressure restriction valve 42B is opened to restrict the final arm-dumping pilot pressure Pb2 to be input to the arm first-speed and second-speed control valves 37 and 38 to the restriction pilot pressure Pir regardless of the magnitude of the arm-dumping operation pilot pressure Pb1.

Thus, the pilot pressure restriction commands to be input to the pilot pressure restriction valves 42A and 42B according to this embodiment define respective upper limits of the final arm-crowding pilot pressure Pa2 and the final arm-dumping pilot pressure Pb2 that are input to the arm first-speed and two-speed control valves 37 and 38.

The controller 50 inputs the pilot pressure restriction command to the pilot pressure restriction valves 42A and 42B to restrict the arm-crowding and arm-dumping pilot pressures, respectively, thereby performing such a control as to stop the piston 27*p* at a position before the stroke end in advance of the arrival of the piston 27*p* of the arm cylinder 27 at the stroke end. The driving apparatus includes a plurality of detection devices as means for providing information necessary for the control to the controller 50. The plurality of detection devices detect physical quantities necessary for the control, and generate detection signals which are electrical signals corresponding to the physical quantities to input them to the controller 50.

Figure 4:
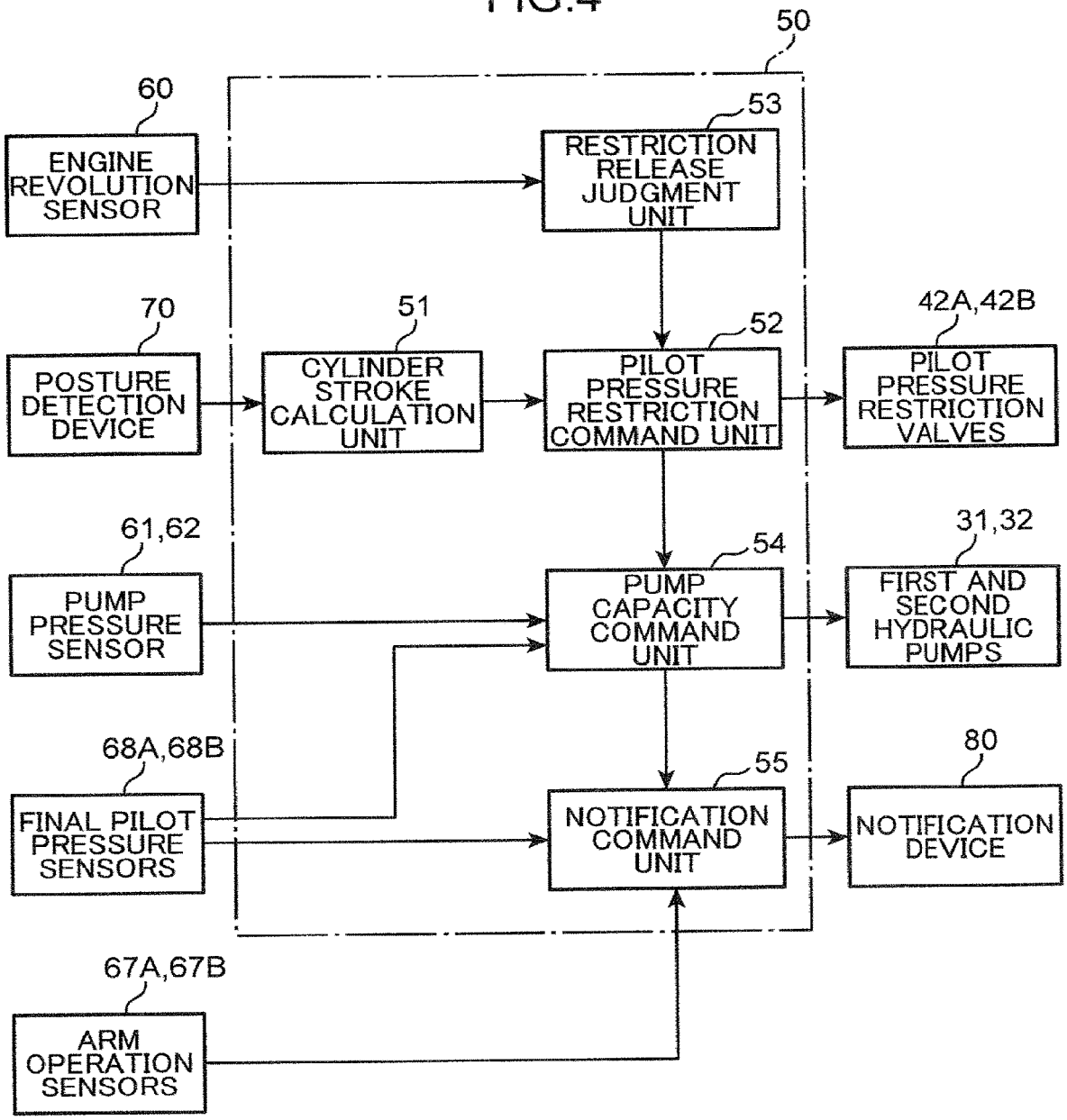
FIG. 4 is a block diagram showing a functional configuration of the controller.

The plurality of detection devices include, as shown in FIGS. 2 and 4, an engine revolution sensor 60, a first pump pressure sensor 61, a second pump pressure sensor 62, an arm-crowding operation sensor 67A, an arm-dumping operation sensor 67B, a final arm-crowding pilot pressure sensor 68A, a final arm-dumping pilot pressure sensor 68B, and a posture detection device 70.

The engine revolution sensor 60 detects the number of revolutions of the engine 30. The first pump pressure sensor 61 detects a first pump pressure P1 which is the pressure of hydraulic fluid discharged from the first main pump 31, and the second pump pressure sensor 62 detects a second pump pressure P2 which is the pressure of hydraulic fluid discharged from the second main pump 32.

The arm-crowding operation sensor 67A is connected to the arm-crowding pilot line 40A at a part upstream of the arm-crowding pilot pressure restriction valve 42A, detecting the arm-crowding operation pilot pressure Pa1 which is an arm-crowding pilot pressure output from the arm pilot valve 47*b*. Similarly, the arm-dumping operation sensor 67B is connected to the arm-dumping pilot line 40B at a part upstream of the arm-dumping pilot pressure restriction valve 42B, detecting the arm-dumping operation pilot pressure Pb1 which is an arm-dumping pilot pressure output from the arm pilot valve 47*b*.

The final arm-crowding pilot pressure sensor 68A is connected to the arm-crowding pilot line 40A at a part downstream of the arm-crowding pilot pressure restriction valve 42A, detecting the final arm-crowding pilot pressure Pa2 which is a pilot pressure at the part to be finally input to the arm-crowding pilot ports 37*a* and 38*a* of the arm first-speed and second-speed control valves 37 and 38, respectively (i.e., the pilot pressure having been restricted when the restriction by the arm-crowding pilot pressure restriction valve 42A is effective). Similarly, the arm-dumping operation sensor 67B is connected to the arm-dumping pilot line 40B at a part downstream of the arm-dumping pilot pressure restriction valve 42B, detecting the final arm-dumping pilot pressure Pb2 which is a pilot pressure at the part to be finally input to the arm-dumping pilot ports 37*b* and 38*b* of the arm first-speed and second-speed control valves 37 and 38, respectively (i.e., the pilot pressure having been restricted when the restriction by the arm-dumping pilot pressure restriction valve 42B is effective).

The posture detection device 70 detects posture information on the work device 14 and is necessary for obtaining the cylinder stroke Sc of the arm cylinder 27 (in this embodiment, the stroke in the expansion direction from the full contraction position at which the arm cylinder 27 is fully contracted). Specifically, the posture detection device 70, as shown in FIG. 1, includes a boom angle sensor 71, an arm angle sensor 72 and a bucket angle sensor 74. The boom angle sensor 71 detects a boom angle that is the rising and falling angle of the boom 21 to the machine body. The arm angle sensor 72 detects an arm angle that is the rotation angle of the arm 22 to the boom 21. The bucket angle sensor 74 detects the bucket angle that is the rotation angle of the bucket 24 to the arm 22.

The controller 50 executes a control for preventing the piston 27*p* of the arm cylinder 27 from reaching the stroke end by restricting the arm-crowding pilot pressure and the arm-dumping pilot pressure (cylinder drive command) as described above, and performs a control of the pump capacities of the first and second main pumps 31 and 32 in response to the restriction on the pilot pressure. As functions related to these controls, the controller 50 includes a cylinder stroke calculation unit 51 as shown in FIG. 4, a pilot pressure restriction command unit 52, a restriction release judgment unit 53, a pump capacity command unit 54, and a notification command unit 55.

The cylinder stroke calculation unit 51 calculates a cylinder stroke Sr of the arm cylinder 27 (the stroke from the full contraction position) based on the posture of the work device 14 detected by the posture detection device 70. The cylinder stroke calculation unit 51, thus, constitutes a cylinder stroke detection unit that detects the cylinder stroke Sr, in cooperation with the posture detection device 70.

The pilot pressure restriction command unit 52 calculates a pilot pressure restriction command corresponding to the cylinder stroke Se calculated by the cylinder stroke calculation unit 51 and inputs it to the arm-crowding pilot pressure restriction valve 42A or the arm-dumping pilot pressure restriction valve 42B, thereby performing necessary restriction on the arm-crowding pilot pressure or the arm-dumping pilot pressure. The pilot pressure restriction command is a command for restriction on the pilot pressure necessary for stopping the piston 27*p* at a position before the stroke end in advance of the arrival of the piston 27*p* at the stroke end, regardless of the arm crowding operation and the arm dumping operation each of which is a cylinder operation applied to the arm operation lever 47*a*. The pilot pressure restriction command unit 52, thus, constitutes a drive command restriction unit according to the present embodiment, in cooperation with the arm-crowding pilot pressure restriction valve 42A and the arm-dumping pilot pressure restriction valve 42B.

Figure 6:
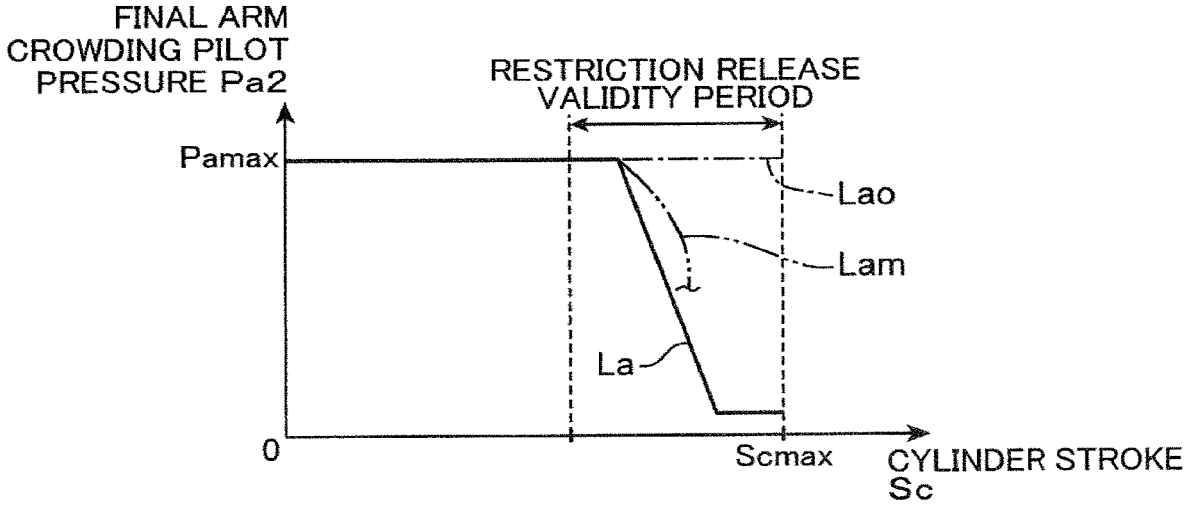
FIG. 6 is a graph showing the relationship between a cylinder stroke of the arm cylinder and a final arm-crowding pilot pressure restricted by the controller.
Figure 7:
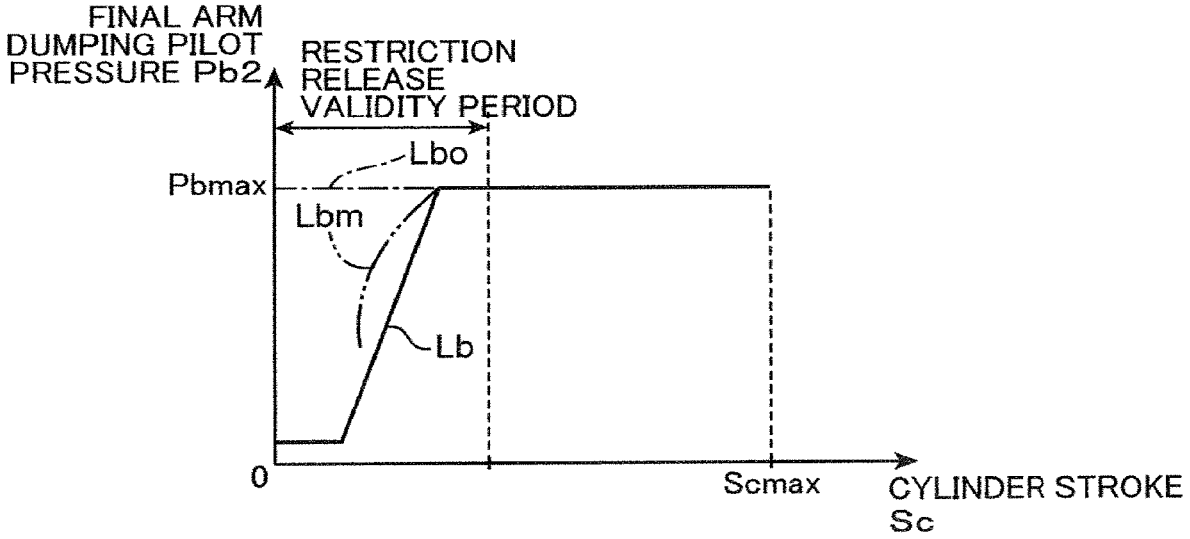
FIG. 7 is a graph showing the relationship between the cylinder stroke of the arm cylinder and a final arm-dumping pilot pressure restricted by the controller.

The pilot pressure restriction command unit 52 stores an arm-crowding pilot pressure restriction characteristic as shown in FIG. 6 and an arm-dumping pilot pressure restriction characteristic as shown in FIG. 7, and generates the pilot pressure restriction command based on the characteristics. The arm-crowding pilot pressure restriction characteristic is a characteristic that is set in advance with respect to the relationship between the cylinder stroke Sc from the full contraction position and the final arm-crowding pilot pressure Pa2 for stopping the piston 27*p* of the arm cylinder 27 at a position before the expansion-side stroke end (i.e. a position at which the cylinder stroke Sc is smaller than the maximum stroke Scmax by a constant stroke) in advance of the arrival of the piston 27*p* at the expansion-side stroke end, the characteristic being indicated by a solid line La in FIG. 6. Similarly, the arm-dumping pilot pressure restriction characteristic is a characteristic that is set in advance with respect to the relationship between the cylinder stroke Sc and the final arm-dumping pilot pressure Pb2 for stopping the piston 27*p* of the arm cylinder 27 at a position before the contraction-side stroke end (i.e. a position at which the cylinder stroke Sc is larger than zero by a constant stroke) in advance of the arrival of the piston 27*p* at the contraction-side stroke end, the characteristic being indicated by a solid line Lb in FIG. 7.

The restriction release judgment unit 53 judges whether or not a preset restriction release condition is satisfied. The restriction release condition is a condition for releasing the restriction on the arm-crowding pilot pressure and the arm-dumping pilot pressure. The restriction release condition according to this embodiment includes the following condition 1 and condition 2. The restriction release judgment unit 53 judges that the restriction release condition is satisfied when any of the condition 1 and the condition 2 is satisfied.

Condition 1: There is applied a specific operation that is different from the normal arm crowding operation or the normal arm dumping operation (special operation) to the arm operation lever 47*a*.

The "special operation" in this embodiment is a turning-back operation. The turning-back operation is an operation of successively performing a reverse operation for moving the piston 27*p* of the arm cylinder 27 in a direction opposite to the direction of the current movement of the piston 27*p* and a forward operation opposite to the reverse direction. The magnitude of the reverse operation required for being identified as the turning-back operation can be appropriately set. The reverse operation may be required, for example, to have a magnitude to stroke to the opposite side across the neutral position. In this case, it is recognized that the turning-back operation has been performed, for example, when the arm operation lever 47*a* is operated in the direction to retract the arm cylinder 27 by a stroke across the neutral position during the motion of the arm cylinder 27 in the expansion direction, namely, the arm crowding direction and successively operated to return the arm operation lever 47*a* to the position for the arm crowding direction.

For the turning-back operation, it is preferable to set a restriction release validity period as shown in FIGS. 6 and 7. The restriction release validity period is a period for allowing the turning-back operation to be deemed to be valid only when the turning-back operation is performed within the restriction release validity period, being a period, in this embodiment, set to correspond to a certain cylinder stroke before each of the expansion-side stroke end and the contraction-side stroke. Thus, it is preferable that the restriction release judgment unit 53 is configured to judge the turning-back operation to be valid to judge the restriction release condition to be satisfied only when the turning-back operation is applied to the arm operation lever 47*a* within the restriction release validity period before the stroke end. This prevents the restriction on the arm-crowding pilot pressure or the arm-dumping pilot pressure from being released contrary to the intention of an operator when the operator applies an operation confused with the turning-back operation as the arm crowding operation or the arm dumping operation to the arm operation lever 47*a*.

Condition 2: The engine number of revolutions Ne detected by the engine revolution sensor 60 is lower than the preset lower limit number of revolutions Neo. Preferably, the lower limit number of revolutions Neo is sufficiently smaller number of revolutions than the number of revolutions for performing work by driving the work device 14 (e.g., idle rotational speed). Thus setting the lower limit number of revolutions Neo allows it to be estimated that the operator has no intention to do any work and that the possibility of parking is high. Hence, performing the release of the restriction when the condition 2 is satisfied enables an operator to perform an operation for forcibly making the arm cylinder 27 reach the stroke end for the parking.

The pilot pressure restriction command unit 52 is configured to release the generation and input of the pilot pressure restriction command, that is, release the restriction on the arm-crowding pilot pressure and the arm-dumping pilot pressure, when the restriction release judgment unit 53 judges that the restriction release condition is satisfied.

The pump capacity command unit 54 generates a pump capacity command and inputs it to the first and second main pumps 31 and 32, thereby controlling respective pump capacities of the first and second main pumps 31 and 32. The pump capacity command unit 54 according to this embodiment generates a pump capacity command for executing a horsepower control considering the maximum horsepower of the engine 30 and a so-called positive control considering the operation applied to the plurality of actuator operation devices.

Specifically, the pump capacity command unit 54 performs: calculating a first pump flow rate and a second pump flow rate for horsepower control (respective flow rates of hydraulic fluids discharged from the first and second main pumps 31 and 32) based on the first and second pump pressures P1 and P2 detected by the first and second pump pressure sensors 61 and 62; calculating pump flow rate parameters for positive control corresponding to respective operations applied to the plurality of actuator operation devices (actually, the pilot pressures generated by the actuator operation devices); and calculating a first pump flow rate and a second pump flow rate for a so-called positive control based on the stun of the pump flow rate parameters. The pump capacity command unit 54 further selects the lower pump flow rate out of the first and second pump flow rates for horsepower control and the first and second pump flow rates for positive control and calculates the pump capacity command for providing the selected pump flow rate, inputting the pump capacity command to the first and second main pumps 31 and 32, respectively.

Figure 8:
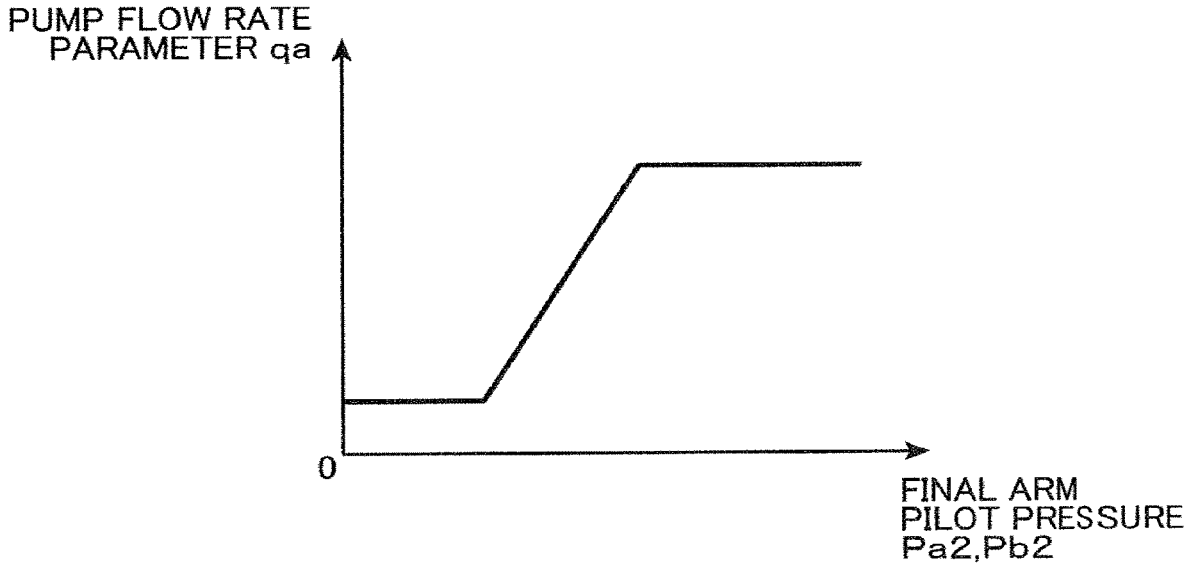
FIG. 8 is a graph showing the relationship between the arm-crowding pilot pressure and the arm-dumping pilot pressure and the pump flow rate parameter calculated by the controller.

The pump capacity command unit 54 according to this embodiment, however, for a pump flow rate parameter qa with respect to the arm cylinder 27 out of the positive control pump flow parameters, performs the calculation of the pump flow parameter qa not based on the arm crowding operation or the arm dumping operation applied to the arm operation lever 47*a* but based on the final arm-crowding pilot pressure Pa2 or the final arm-dumping pilot pressure Pb2 detected by the final pilot pressure sensor 68A or 68B. Specifically, the pump capacity command unit 54 stores the predetermined characteristics of the pump flow parameter qa for the arm cylinder 27 to the final arm pilot pressures Pa2 and Pb2 as shown in FIG. 8, and, based on the stored characteristic, calculates the pump flow parameter qa corresponding to the final arm pilot pressure Pa2 or Pb2.

The notification command unit 55 compares the arm-crowding operation pilot pressure Pa1 and the final arm-crowding pilot pressure Pa2 when these pilot pressures are generated, and, conversely, compares the arm-dumping operation pilot pressure Pb1 and the final arm-dumping pilot pressure Pb2 when these pilot pressures are generated. In any of the cases, the notification command unit 55 generates a notification command when the operating pilot pressure Pa1 or Pb1 is equivalent to or larger than the final pilot pressure Pa2 or Pb2, and inputs the notification command to a notification device 80. For example, if provided in the cab 18, the notification device 80 makes a notification that the operation pilot pressure Pa1 or Pb1 is equal to or more than the final pilot pressure Pa2 or Pb2, by well-known means such as a screen display or sound, when receiving the input of the notification command from the notification command unit 55.

Next will be described a specific arithmetic control operation performed by the controller 50 with reference to the flowchart in FIG. 5 and respective graphs in FIGS. 6 to 8.

Figure 5:
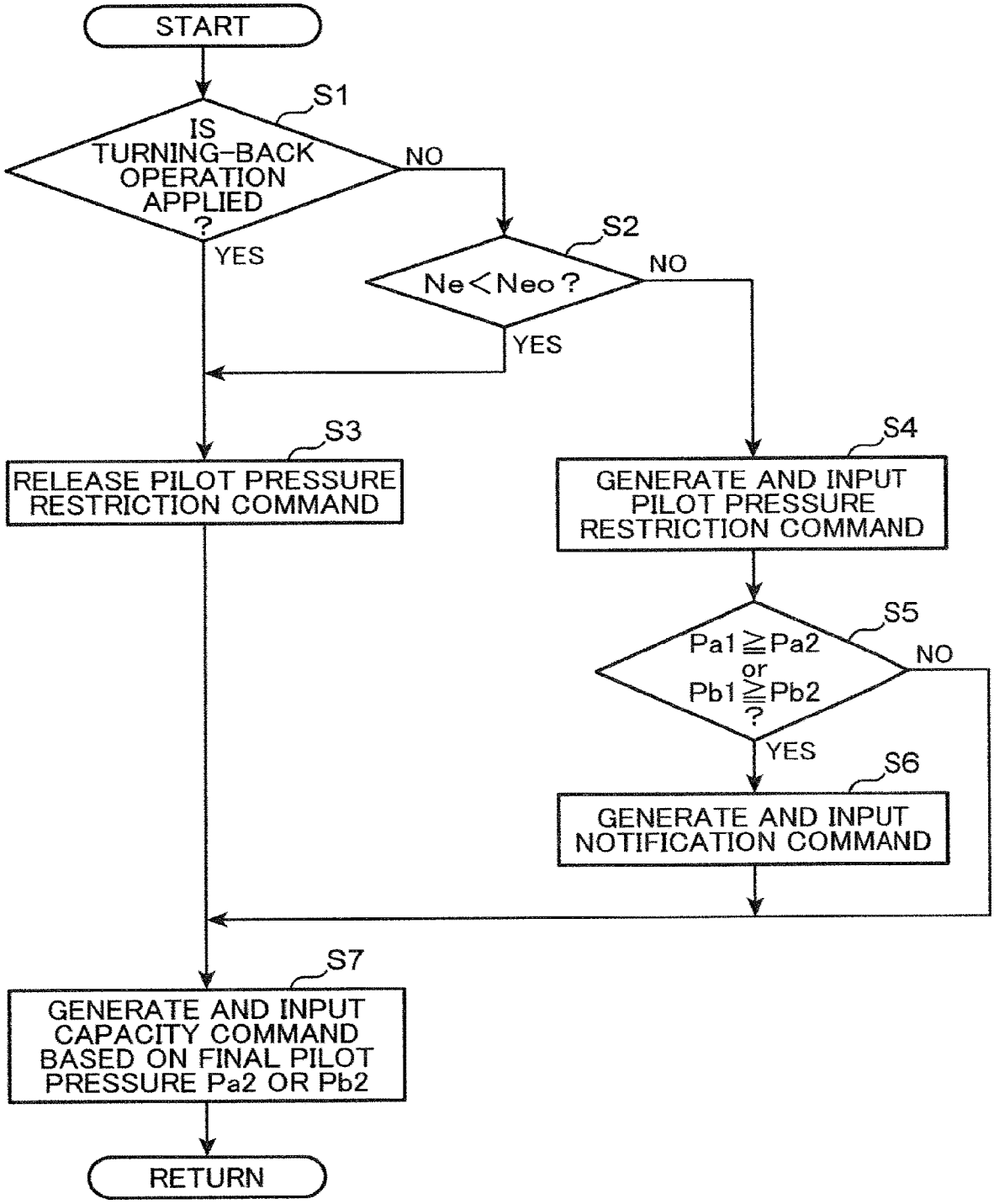
FIG. 5 is a flowchart showing a control operation for the arm cylinder, the operation executed by the controller.

In steps S1 and S2 of FIG. 5, the restriction release judgment unit 53 of the controller 50 judges whether or not the above-mentioned restriction release condition is satisfied. When the restriction release judgment unit 53 judges that the restriction release condition is satisfied, specifically, when the restriction release judgment unit 53 judges that a predetermined turning-back operation is applied to the arm operation lever 47*a* within the restriction release validity period shown in FIGS. 6 and 7 (YES in step S1), or when the engine number of revolutions Ne detected by the engine revolution sensor 60 is equal to or less than the predetermined lower limit number of revolutions Neo (YES in step S2), the pilot pressure restriction command unit 52 releases the restriction on the pilot pressure (step S3).

Specifically, the restriction release judgment unit 53 stops the input of a pilot pressure restriction command to the pilot pressure restriction valves 42A and 42B, and allows the arm-crowding operation pilot pressure Pa1 or the arm-dumping pilot pressure Pb1 generated by the arm crowding operation or the arm dumping operation applied to the arm operation lever 47*a* to be directly input to the arm-crowding pilot ports 37*a* and 38*a* or the arm-dumping pilot ports 37*b* and 38*b* of the arm first-speed and second-speed control valves 37 and 38 as the final arm-crowding pilot pressure Pa2 or the final arm-dumping pilot pressure Pb2, regardless of the magnitude thereof. For example, if the arm operation lever 47*a* is fully operated, the final arm-crowding pilot pressure Pa2 or the final arm-dumping pilot pressure Pb2 is kept at the maximum value thereof (Pamax or Pbmax) as shown in one-dot chain lines Lao and Lbo in FIGS. 6 and 7, respectively, allowing the piston 27*p* of the arm cylinder 27 to reach the stroke end with no deceleration.

On the other hand, when the restriction release judgment unit 53 judges that the restriction release condition is not satisfied, specifically, when the restriction release judgment unit 53 judges that no predetermined turning-back operation is applied to the arm operation lever 47*a* within the restriction release validity period shown in FIGS. 6 and 7 (NO in step S1) and that the engine number of revolutions Ne detected by the engine revolution sensor 60 exceeds the lower limit number of revolutions Neo (NO in step S2), the pilot pressure restriction command unit 52 generates a pilot pressure restriction command and inputs the pilot pressure restriction command to the arm-crowding pilot pressure restriction valve 42A or the arm-dumping pilot pressure restriction valve 42B (step S4). The final arm-crowding pilot pressure Pa2 or final arm-dumping pilot pressure Pb2, which is the pilot pressure finally input to the arm first-speed and second-speed control valves 37 and 38, is thereby restricted according to the restriction characteristics shown in FIGS. 6 and 7, thus being forced to be reduced before the stroke end regardless of the arm crowding operation or the arm dumping operation actually applied to the arm operation lever 47*a*.

The restriction on the final pilot pressure Pa2 or Pb2 reduces respective valve strokes of the arm first-speed and the second-speed control valves 37 and 38 (the strokes of the spools from the neutral positions), causing the piston 27*p* of the arm cylinder 27 to automatically start decelerating at a predetermined position before the stroke end and to stop in advance of the arrival thereof at the stroke end. This prevents the piston 27*p* and the cylinder body 27*c* from making impact contact with each other. Besides, even if such a cushioning structure or similar structure as shown in FIG. 3 is provided at each stroke end, energy loss due to the dash to the stroke end and the departure from the stroke end of the piston 27*p* is effectively reduced.

Upon such pilot pressure restriction, the notification command unit 55 of the controller 50 makes comparison between the arm-crowding operation pilot pressure Pa1 and the final arm-crowding pilot pressure Pa2 or comparison between the arm-dumping operation pilot pressure Pb1 and the final arm-dumping pilot pressure Pb2, and, when the operation pilot pressure Pa1 or Pb1 is equal to or greater than the final pilot pressure Pa2 or Pb2 (YES in step S5), inputs the notification command to the notification device 80 to make it perform the notification. For example, when the arm-crowding operation pilot pressure Pa1 exceeds the final arm-crowding pilot pressure Pa2 (namely, the restriction pilot pressure Pir) as indicated by the two-dot chain line Lam in FIG. 6, or when the arm-dumping operation pilot pressure Pb exceeds the final arm-dumping pilot pressure Pb2 (namely, the restriction pilot pressure Pir) as indicated by the two-dot chain line Lbm in FIG. 7, the notification device 80 notifies it, specifically, that the operation pilot pressure Pa1 or Pbe exceeds the final pilot pressure Pa2 or Pb2, to the operator. This notification allows the operator not only to know that the deceleration of the piston 27*p* is caused by not a failure but the restriction on the pilot pressure but also to recognize that the operation actually applied to the operation member by the operator is too large to stop the piston at a position before the stroke end. This can contribute to improved operator skill for performing such manual operation as to prevent impact at the stroke end of the arm cylinder 27.

The pump capacity command unit 54 of the controller 50 calculates the pump flow parameter qa (FIG. 8) for positive control not based on the operation pilot pressure Pa1 or Pb1 corresponding to the operation applied to the arm operation lever 47*a* but based on the final pilot pressure Pa2 or Pb2 finally input to the arm first-speed and the second-speed control valves 37 and 38, regardless of presence or absence of restriction on the arm-crowding pilot pressure or arm-dumping pilot pressure, generating a final pump capacity command by use of the pump flow parameter qa and inputting it to the first and second main pumps 31 and 32 (step S7). Thus calculating the pump flow parameter based on the final pilot pressures Pa2 and Pb2 enables more efficient operation of the first and second main pumps 31 and 32 to be done in consideration with the reduction in the required flow rate of the arm cylinder 27 due to the restriction on the pilot pressure to be performed, as compared with a normal positive control, i.e., a pump control based on an operation actually applied to the arm operation lever 47*a*.

The present invention is not limited to the embodiments described above. The present invention encompasses, for example, the following modes.

(A) Objects to be Driven and Restrictions on Drive Commands

The hydraulic cylinder to be driven by the apparatus according to the present invention is not limited to the arm cylinder 27. The hydraulic cylinder may be, for example, either the boom cylinder 26 or the bucket cylinder 28, or alternatively an option cylinder for actuating an option device attached to the distal end of the arm 22 in place of the bucket 24. Besides, the driving apparatus according to the present invention may be applied to a plurality of hydraulic cylinders installed in a common working machine.

The restriction on the cylinder drive command according to the present invention may be done with respect to only one of the expansion-side stroke end and the contraction-side stroke end. For example, when the impact at the contraction-side stroke end is remarkable as compared with that at the expansion-side stroke end, it is also acceptable to restrict only the drive command for the contraction-side stroke end.

(B) Restriction Release

In the present invention, the restriction release operation performed for releasing the restriction is not limited to the turning-back operation applied to the arm operation lever 47*a* or other operation member. The restriction release operation may be another type of operation to be applied to the operation member, or may be an operation to be applied to an exclusive switch prepared separately from the operation member only for restriction release. For example, there may be provided a restriction release switch allowing a pressing operation to be applied thereto in a specific part of the arm operation lever 47*a*.

Besides, according to the present invention, the release of the restriction on the cylinder drive command is optional. In other words, it is also acceptable that the restriction on the cylinder drive command is always performed. Enabling the restriction to be released, meanwhile, has the advantage of allowing an operator to intentionally make the hydraulic cylinder reach the stroke end. For example, in the case of applying the driving apparatus according to the present invention to the bucket cylinder 28, releasing the restriction allows an operator to do work for dropping mud or soil adhering to the bucket 24 by use of impact caused by the piston reaching the stroke end in the bucket cylinder 28.

(C) Drive Command Input Unit and Drive Command Restriction Unit

The drive command input unit according to the present invention is not limited to the combination of the pilot pump 34 and the arm pilot valve 47*b* as shown in FIG. 2 (that is, means for generating an operation pilot pressure). The invention can also be applied to an electrical operation type of driving apparatus.

Figure 9:
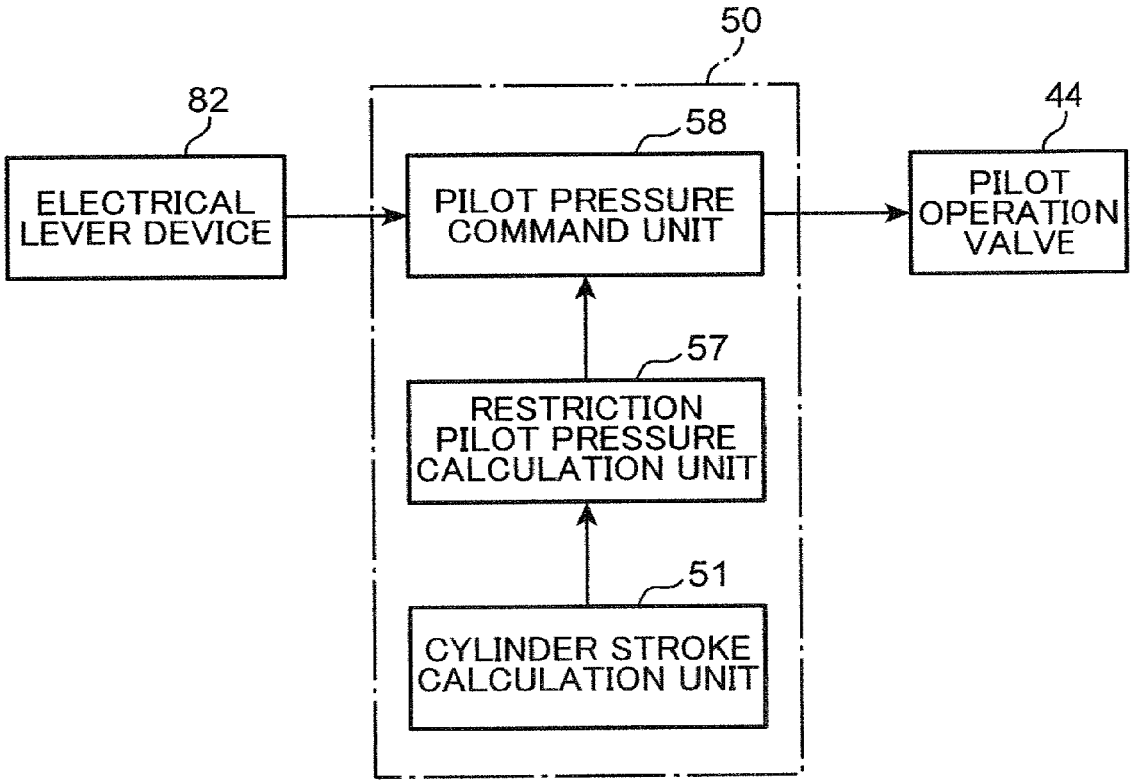
FIG. 9 is a block diagram showing a functional configuration of a controller according to a modification of the present invention.

FIG. 9 shows a controller 50A that is an example thereof, namely, according to modification. The controller 50A is connected with an electric lever device 82 and a pilot operation valve 44. The electric lever device 82 allows a cylinder operation to be applied thereto by an operator, generating an operation signal that is an electric signal corresponding to the cylinder operation and inputting the operation signal to the controller 50A. The pilot operation valve 44 is a solenoid valve interposed between a not-graphically-shown pilot hydraulic pressure source (e.g., the above-described pilot pump 34) and a pilot-operated cylinder control valve (e.g., a solenoid proportional pressure reducing valve), configured to be opened so as to allow a pilot pressure corresponding to the pilot pressure command input from the controller 50 to be input to the cylinder control valve.

The controller 50A includes a restriction pilot pressure calculation unit 57 and a pilot pressure command unit 58 in place of the pilot pressure restriction command unit 52 of the controller 50 shown in FIG. 4. The restriction pilot pressure calculation unit 57 calculates a restriction pilot pressure for preventing the piston of the hydraulic cylinder from reaching the stroke end. The pilot pressure command unit 58 compares the operation pilot pressure corresponding to the operation signal input from the electric lever device 82 with a restriction pilot pressure calculated by the restriction pilot pressure calculation unit 57, and inputs a pilot pressure command to the pilot operation valve 44 so as to let the lower pilot pressure out of the compared pressures be finally input to the cylinder control valve.

In this modification, the operation lever to which the cylinder operation is applied in the electric lever device 82 corresponds to the operation member according to the present invention, and the section generating and outputting the operation signal and the pilot pressure command unit 58 constitute a drive command input unit in cooperation with the pilot hydraulic source. Besides, the pilot pressure command unit 58 constitutes a drive command restriction unit in cooperation with the restriction pilot pressure calculation unit 57. Similarly to the controller 50 according to the first embodiment, the controller 50A can include at least one of the restriction release judgment unit 53, the pump capacity command unit 54, and the notification command unit 55 shown in FIG. 4.

(D) Cylinder Control Valve

The cylinder control valve according to the present invention only has to be one that is connected to the hydraulic cylinder to be driven, thus not limited to the arm first-speed and the second-speed control valves 37 and 38. For example, in the case where the object to be driven is the boom cylinder 26 or the bucket cylinder 28, the boom control valve or the bucket control valve corresponds to the cylinder control valve according to the present invention. Besides, the number of the cylinder control valve is not limited; there may be a plurality of control valves connected to a common driving object similarly to the arm first-speed and the second-speed control valves 37 and 38.

(E) Drive Command Restriction Characteristic

In the present invention, the restriction characteristics of the cylinder drive command for preventing the piston of the hydraulic cylinder from reaching the stroke end with respect to the cylinder stroke are not limited to the characteristics as shown in FIGS. 6 and 7. The characteristic may be one, for example, provided by a smooth curve, or one that restricts the drive command over a plurality of stages.

(F) Pump Capacity Control

In the present invention, the pump capacity control is optional. For example, the hydraulic pump for driving the hydraulic cylinder may be a fixed displacement type of one. Besides, when a pump volume control involving the calculation of the pump flow rate for positive control is conducted, the calculation of the pump flow rate is not limited to one based on the final pilot pressure detected by the pilot pressure sensor, such as the final arm-crowding and arm-dumping pilot pressure sensors 68A and 68B shown in FIG. 2. The calculation may be performed, for example, based on the lower pilot pressure (i.e., the final pilot pressure) out of the operating pilot pressure Pa1 or Pb1 and the restriction pilot pressure Pir corresponding to the pilot pressure restriction command input from the pilot pressure restriction command unit 52 shown in FIG. 4 to the pilot pressure restriction valves 42A and 42B.

As described above, according to the present invention, there is provided an apparatus for driving a hydraulic cylinder installed in a working machine, the apparatus being capable of effectively preventing an impact at a stroke end of the hydraulic cylinder and reducing energy loss.

Provided is an apparatus installed in a work machine to drive a hydraulic cylinder including a piston and a cylinder body forming a cylinder chamber that accommodates the piston so as to allow the piston to be reciprocated, the apparatus including: a hydraulic pump that discharges hydraulic fluid to be supplied to the cylinder chamber of the hydraulic cylinder; a cylinder control valve interposed between the hydraulic pump and the hydraulic cylinder and configured to be opened by input of a cylinder drive command to the cylinder control valve to change a direction and a flow rate of the hydraulic fluid supplied from the hydraulic pump to the hydraulic cylinder in response to the cylinder drive command; an operation member allowing a cylinder operation for moving the hydraulic cylinder to be applied to the operation member by an operator; a drive command input unit that generates the cylinder drive command corresponding to the cylinder operation applied to the operation member and inputs the cylinder drive command to the cylinder control valve; a cylinder stroke detection unit that detects a cylinder stroke that is a stroke of the hydraulic cylinder; and a drive command restriction unit that restricts the cylinder drive command to be input from the drive command input unit to the cylinder control valve in response to the cylinder stroke so as to stop the piston before a stroke end of the hydraulic cylinder regardless of the cylinder operation.

According to this apparatus, the drive command restriction unit, which restricts the cylinder drive command to be input to the cylinder control valve so as to stop the piston before the stroke end regardless of the cylinder operation applied to the operation member by the operator, enables the piston to be reliably prevented from causing an impact by the dash thereof onto the stroke end and allows energy loss due to the dash and the departure of the piston to and from the stroke end to be effectively reduced to thereby improve drive efficiency.

It is preferable that the hydraulic drive device further includes a restriction release judgment unit that judges whether or not a restriction release condition that is preset for releasing the restriction on the cylinder drive command is satisfied, and the drive command restriction unit is configured to release the restriction on the cylinder drive command when the restriction release judgment unit judges that the restriction release condition is satisfied. The release of the restriction on the cylinder drive command enables the restriction on the cylinder drive command to be performed only in suitable cases. In other words, it enables the restriction to be prevented from being performed in a situation requiring no restriction on the cylinder drive command.

Preferably, the restriction release condition is, for example, a condition that a predetermined restriction release operation for releasing the restriction on the cylinder drive command is performed by an operator. This condition enables a control to be conducted in respect for the operator's intention to dare to allow the piston to reach the stroke end. For example, in the case of using the hydraulic cylinder for driving a bucket in a hydraulic excavator, the operator can perform, by performing the restriction release operation, such an operation as to drop mud or soil adhering to the bucket by utilization of the impact at the stroke end in the hydraulic cylinder (a so-called skeleton operation).

The restriction release operation, while being allowed to be, for example, a dedicated switch provided separately from the operation member for the restriction release operation, is, more preferably, a special operation that is applied to the operation member but is different from the cylinder operation. This allows an operator to perform the restriction release operation by direct use of the operation member that is normally used for the input of the cylinder drive command.

For example, the special operation is preferably a turning-back operation. The turning-back operation is an operation of successively performing a reverse operation for moving the piston in a direction opposite to a direction of a current movement of the piston and a forward operation opposite to the reverse operation. The turning-back operation, though being a simple operation, is clearly distinguishable from the normal operation for inputting the cylinder drive command.

It is more preferable that the restriction release judgment unit is configured to deem the special operation to be valid (i.e., to judge that the restriction release condition is satisfied) only when the special operation is performed within a release validity range which is a fixed stroke range that is set before the stroke end. Thus limiting the stroke range for considering the special operation to be valid is effective in preventing the restriction on the cylinder drive command from being released against the intention of the operator who performs an operation similar to the special operation for a purpose other than the purpose of releasing the restriction.

The restriction release condition may be a condition that the number of revolutions of the engine installed in the working machine is lower than a preset lower limit number of revolutions. Thus releasing the restriction on the cylinder drive command when the engine speed is so low that the possibility of parking the working machine is high allows an operator to perform an operation of forcibly making the piston reach the stroke end for the parking.

It is preferable that the apparatus further includes a notification unit that notifies, in a case where the cylinder drive command corresponding to the cylinder operation actually applied to the operation member by the operator is larger than the drive command having being restricted by the drive command restriction unit, the case to the operator. The notification enables the operator to know that the deceleration of the piston is caused by not a failure but the restriction on the cylinder drive command. Besides, it allows an operator to know that the operation actually applied to the operation member by the operator is too large to stop the piston at a position before the stroke end, thereby contributing to improved skill of the operator.

In the case where the hydraulic pump is a variable displacement pump, it is preferable that the driving apparatus further includes a pump capacity control unit that controls the pump capacity of the hydraulic pump, the pump capacity control unit configured to control the capacity of the hydraulic pump based on the cylinder drive command finally input to the cylinder control valve, regardless of the cylinder operation applied to the operation member. The pump capacity control unit, configured to control the capacity of the hydraulic pump based on the restricted final cylinder drive command when the drive command restriction unit restricts the cylinder drive command, even when the cylinder drive command corresponding to the cylinder operation is large, allows energy for the operation of the hydraulic pump to be reduced.

The invention claimed is:

1. An apparatus installed in a working machine to drive a hydraulic cylinder including a piston and a cylinder body forming a cylinder chamber that accommodates the piston so as to allow the piston to be reciprocated, the apparatus comprising:

a hydraulic pump that discharges hydraulic fluid to be supplied to the cylinder chamber of the hydraulic cylinder;

a cylinder control valve interposed between the hydraulic pump and the hydraulic cylinder and configured to be opened by input of a cylinder drive command to the cylinder control valve to change a direction and a flow rate of the hydraulic fluid supplied from the hydraulic pump to the hydraulic cylinder in response to the cylinder drive command;

an operation member allowing a cylinder operation for moving the hydraulic cylinder to be applied to the operation member by an operator;

a drive command input unit that generates the cylinder drive command corresponding to the cylinder operation applied to the operation member and inputs the cylinder drive command to the cylinder control valve;

a cylinder stroke detection unit that detects a cylinder stroke that is a stroke of the hydraulic cylinder;

a drive command restriction unit that restricts the cylinder drive command to be input from the drive command input unit to the cylinder control valve in response to the cylinder stroke so as to stop the piston before a stroke end of the hydraulic cylinder regardless of the cylinder operation; and a restriction release judgment unit that judges whether or not a restriction release condition that is preset for releasing the restriction on the cylinder drive command is satisfied, the drive command restriction unit configured to release the restriction on the cylinder drive command when the restriction release judgment unit judges that the restriction release condition is satisfied, wherein the restriction release condition is a condition that a number of revolutions of an engine installed in the work machine is lower than a preset lower limit number of revolutions.

2. The hydraulic cylinder driving apparatus according to claim 1, wherein the restriction release condition is a condition that a predetermined restriction release operation for releasing the restriction on the cylinder drive command is performed by an operator.

3. The hydraulic cylinder driving apparatus according to claim 2, wherein the restriction release operation is a special operation applied to the operation member, the special operation being different from the cylinder operation.

4. The hydraulic cylinder driving apparatus according to claim 3, wherein the special operation is a turning-back operation, which is an operation of successively performing a reverse operation for moving the piston in a direction opposite to the direction of a current movement of the piston and a forward operation opposite to the reverse operation.

5. The hydraulic cylinder driving apparatus according to claim 3, wherein the restriction release judgment unit is configured to deem the special operation to be valid only when the special operation is performed within a release validity range which is a fixed stroke range set before the stroke end.

6. The hydraulic cylinder driving apparatus according to claim 1, further comprising a notification unit that notifies, in a case where the cylinder drive command corresponding to the cylinder operation actually applied to the operation member by the operator is larger than the drive command being restricted by the drive command restriction unit, the case to the operator.

7. The hydraulic cylinder driving apparatus according to claim 1, wherein the hydraulic pump is a variable displacement pump, the driving apparatus further comprising a pump capacity control unit that controls a pump capacity of the hydraulic pump, the pump capacity control unit configured to control a capacity of the hydraulic pump based on the cylinder drive command finally input to the cylinder control valve regardless of the cylinder operation applied to the operation member.

* * * * *